US005487343A

United States Patent [19]

Phillips

[11] Patent Number: 5,487,343

[45] Date of Patent: Jan. 30, 1996

[54] PALLET/SKID SHIPPING PLATFORM

[76] Inventor: Stewart A. Phillips, 9677 Hillview Ct., Newburgh, Ind. 47630

[21] Appl. No.: 262,626

[22] Filed: Jun. 20, 1994

[51] Int. Cl.[6] ..... B65D 19/00

[52] U.S. Cl. ..... 108/51.1; 108/56.1; 108/55.3

[58] Field of Search ..... 108/51.1, 55.5, 108/56.1, 55.1, 56.3, 55.3

[56] References Cited

U.S. PATENT DOCUMENTS

| | | | |
|---|---|---|---|
| 2,614,689 | 10/1952 | Miller | 108/55.5 X |
| 2,651,486 | 9/1953 | Woodward | 108/51.1 X |
| 2,794,611 | 6/1957 | Sjoblom et al. | 108/51.1 |
| 3,122,108 | 2/1964 | Arthur | 108/51.1 |
| 3,251,320 | 5/1966 | Whittle, Jr. | 108/51.1 |
| 3,331,496 | 7/1967 | Marsden et al. | 108/55.5 X |
| 3,645,215 | 2/1972 | Kirkpatrick | 108/51.1 |
| 4,715,294 | 12/1987 | Deoew | 108/51.1 |

FOREIGN PATENT DOCUMENTS

| | | | |
|---|---|---|---|
| 2573041 | 5/1986 | France | 108/51.1 |

*Primary Examiner*—Jose V. Chen

*Attorney, Agent, or Firm*—Woodard, Emhardt, Naughton, Moriarty & McNett

[57] ABSTRACT

A storage platform including a plurality of deck boards fastened to runners by brackets. The bracket includes a pair of spaced apart side walls attached to the side of the runner. The bracket side walls are attached to a bracket end wall, in turn, attached to a top wall spaced apart from the side walls forming a slot through which the deck board extends and is fastened thereto. In one embodiment, a bottom wall is spaced apart from the side walls to receive a bottom deck board whereas in another embodiment, the outer bottom corner portion is beveled and recessed to receive a cargo band limiting sideways motion of the band.

7 Claims, 2 Drawing Sheets

PALLET/SKID SHIPPING PLATFORM

BACKGROUND OF THE INVENTION

1. Field of the Invention:

This invention is in the field of pallets and skids upon which cargo may be stored.

2. Description of the Prior Art:

A variety of different types of pallets and skids have been devised for storing and shipping cargo. The pallets and skids are commonly produced from wood although a variety of other materials have been used including plastic.

Wooden skids frequently become damaged as a result of the forks of a forklift impacting the ends of the skid runners. Further, the skid runners develop cracks along growth lines as a result of the natural drying process. The lifting force applied by the forklift to the deck boards extending across and attached to the skid runners results in the force being applied to the runners along the cracks. As a result, the skid runners will split separating the deck boards from the runners. The damaged wooden skids are scraped and assigned to the landfill due to the cost involved in repairing the damaged skids. With the increased emphasis on minimizing landfills and with the further objective of increasing the durability of wooden skids to allow extended life for reuse, I have devised and disclose herein a bracket mountable to the end of the runners securing the deck boards thereto which eliminates the aforementioned splitting and separation problem as well as providing for a structurally improved skid.

SUMMARY OF THE INVENTION

One embodiment of the present invention is a storage platform comprising a plurality of parallel wooden elongated runners, each of the runners including a pair of opposite ends with parallel opposite side surfaces extending therebetween and a top surface extending perpendicularly to and between the side surfaces. A plurality of top wooden elongated deck boards each mounted to and extending perpendicularly across the runners at the ends rest atop the top surface. Brackets positioned adjacent and fixedly attached to the side surfaces and the deck boards limit splitting of the runners at the ends as lifting force is applied to the deck boards.

Another embodiment of the present invention is a storage platform comprising a plurality of wooden beams and a plurality of top boards fixedly mounted to and atop the beams. A plurality of bottom boards are fixedly mounted to and beneath the beams. A plurality of metal brackets fixedly mount the top boards and the bottom boards to the beams. The brackets include top slots and bottom slots through which respectively the top boards and the bottom boards extend.

It is an object of the present invention to provide a new and improved pallet/skid construction.

A further object of the present invention is to provide a wooden skid having increased durability and extended life for reuse.

An additional object of the present invention is to provide a skid having means limiting splitting of the skid runners as a result of lifting force applied to the skid deck boards.

A further object of the present invention is to provide a storage platform having means to limit sideways motion of bands extending around the platform to secure cargo thereatop.

Likewise, it is an object of the present invention to provide a bracket for securing deck boards to runners which may be economically and efficiently produced from a sheet of metal minimizing waste thereof.

Related objects and advantages of the present invention will be apparent in the following description.

DESCRIPTION OF THE PREFERRED EMBODIMENTS

Figure 4:
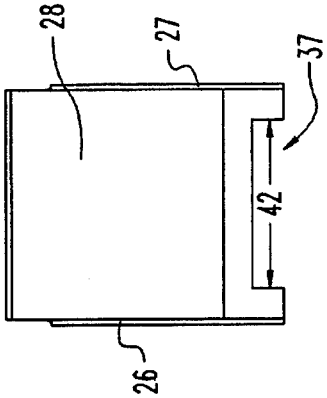
FIG. 4 is a rear view of the bracket of FIG. 2.
Figure 3:
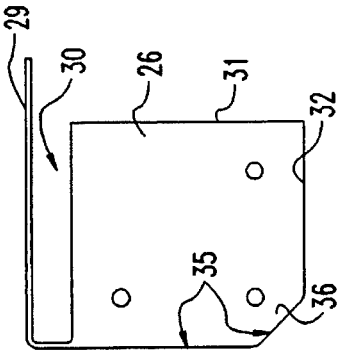
FIG. 3 is a side view of the bracket of FIG. 2.
Figure 2:
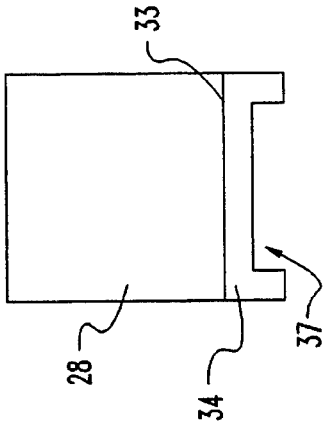
FIG. 2 is a front view of the bracket mounted to the ends of the runners of FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
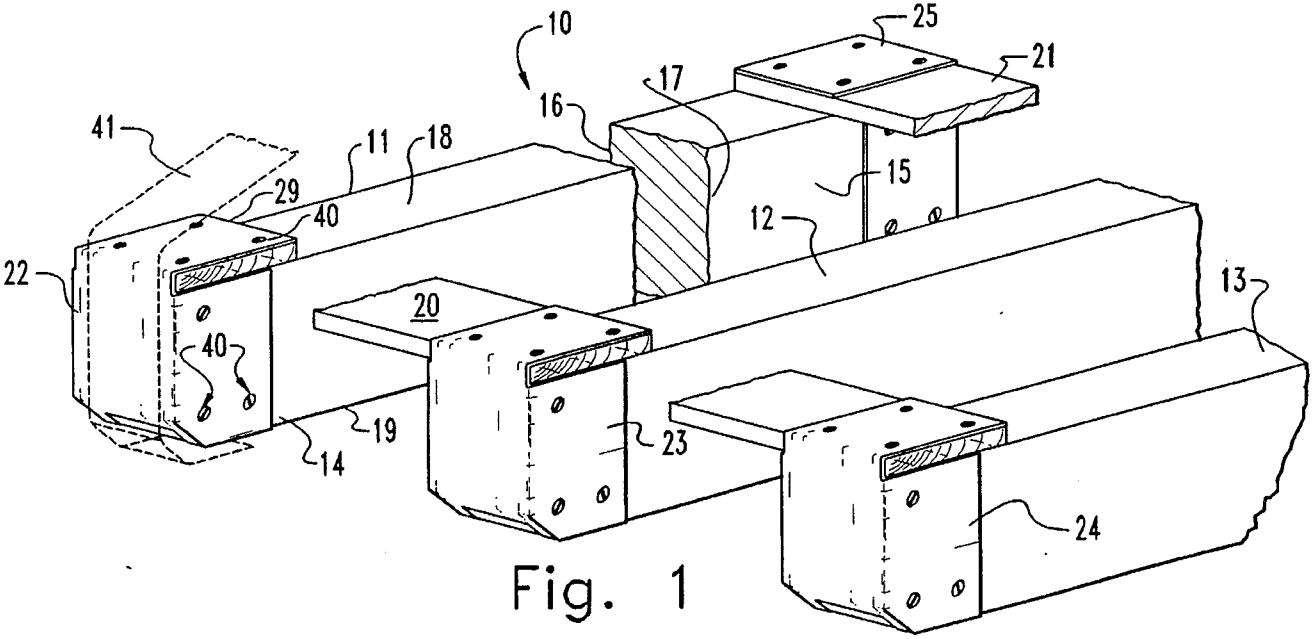
FIG. 1 is a fragmentary perspective view of the preferred embodiment of the skid incorporating my new invention.
Figure 7:
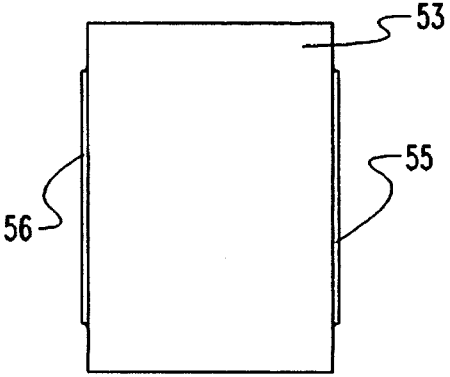
FIG. 7 is a front view of the bracket of FIG. 5.

Referring now more particularly to FIG. 1, there is shown a skid having a plurality of wooden runners or beams fastened together by means of transversely extending deck boards attached thereto by brackets mounted to the opposite ends of the runners. The runners and boards have been fragmented to more clearly illustrate the skid.

Skid 10 includes three parallel wooden elongated runners 11, 12 and 13 with each runner having a generally rectangular cross section. Each runner includes a pair of opposite ends 14 and 15 with parallel and vertical side surfaces 16 and 17 extending between the opposite ends. The top surface 18 and bottom surface 19 of each beam are arranged and extend perpendicularly to and between side surfaces 16 and 17. Runner 11 has been illustrated has having a pair of opposite ends 14 and 15 it being understood that runners 12 and 13 likewise have opposite ends.

A pair of top wooden elongated deck boards 20 and 21 are each mounted to and extend perpendicularly across runners 11, 12 and 13 being positioned adjacent ends 14 and 15 of each runner. Deck boards 20 and 21 rest atop the top surface 18 of each runner and are secured to the runners by a plurality of brackets mounted to the runners at the opposite ends. For example, brackets 22, 23 and 24 are fixedly mounted to the ends 14 of the runners 11, 12 and 13 with three additional brackets mounted to the opposite ends of the runners. Bracket 25 is depicted as mounted to end 15 of runner 11.

Brackets 22–25 are identical and thus the following description will apply equally to each. Bracket 22 includes a pair of vertical side walls 26 and 27 integrally joined and perpendicularly arranged to end wall 28. A top wall 29 is integrally and cantileverly mounted to end wall 28 and is spaced apart from the upper edge of side walls 26 and 27 forming a slot 30 through which the deck boards extend. Top wall 29 extends beyond the edge 31 of side walls 26 and 27. End wall 28 terminates between top wall 29 and the lower edge 32 of the side walls. The bottom 33 of end wall 28 is integrally joined to a comer wall 34 which extends at an obtuse angle 35 relative to the end wall 28 forming a beveled configuration for the outer bottom corner wall portion 36 of the bracket. A recess 37 is formed in comer wall 34 and is located equidistant between side walls 26 and 27.

The brackets are positioned on the opposite ends of each runner with the deck boards then being extended through the bracket slots. Fastening devices such as screws are then used to secure the resulting assembly of bracket, deck boards and runners together. For example, bracket 22 is positioned on end 14 of runner 11 so that the vertical side walls 26 and 27 are positioned adjacent to the side surfaces 16 and 17 of the runner. Standard fastening devices extend through holes 40 of top wall 29 and into deck board 20 and runner 11. In similar fashion brackets 23 and 24 are mounted to runners 12 and 13 with deck board 20 extending into the bracket slots and being attached thereto by fastening devices. Likewise, fastening devices extend into holes 40 of walls 26 and 27 into the runner.

The brackets provide a bracket means which are mounted to the runners at the ends of the runners and are positioned adjacent and fixedly attached to side surfaces 16 and 17 of the runners. In the event the ends of the runners develop splits due to the normal drying process, the side walls 26 and 27 which are anchored to the runner ends and positioned adjacent side surfaces 16 and 17 limit the splitting of the ends since the bracket side walls provide a structural support holding the beam end together. Likewise, when lifting force is applied to the bottom surface of deck boards 20 by a forklift in order to lift the skid upwardly, top wall 29 transfers the lifting force through the end wall 28 and to side walls 26 and 27 and thus to the end of the runner. As a result, deck board 20 is prevented from separating from the runner end.

Metal bands are used to secure cargo atop platforms and skids with the band extending over the cargo and around the opposite ends of the skid and then extending beneath and across the bottom of the skid. One such band 41 (FIG. 1) is shown in fragment as extending over cargo positioned atop the runners with band 41 then extending downwardly adjacent the outer surface of end wall 28 with the band having a width less than the width 42 (FIG. 4) of recess 37. The band extends into recess 37 against the end of runner with the band then extending the length of the runner and around the opposite bracket and eventually over the cargo with the opposite ends of the band then being secured together. Thus, band 41 is located within recess 37 which provides a band retaining means operable to limit motion of the band relative to the side walls 26 and 27 of the bracket.

Bracket 22 is particularly advantageous in that it may be formed by blanking a T-shaped pattern from a metal sheet and then bending the arms of the T to form side walls 26 and 27 and with the end portion of the main segment of the T being bent to form top wall 29. By alternating adjacent T-shaped blanks, it is possible to utilize an entire metal sheet while minimizing portions of the sheet which may not be used.

Figure 5:
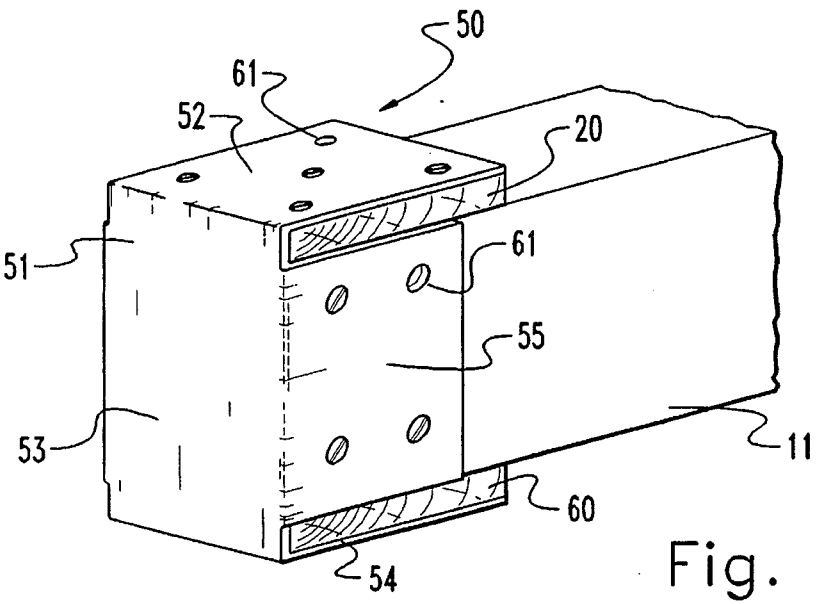
FIG. 5 is a fragmentary perspective view of an alternate embodiment of the skid showing the runner with bracket and deck boards.
Figure 6:
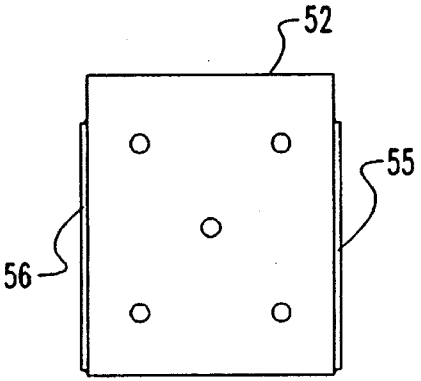
FIG. 6 is top view of the bracket of FIG. 5.

An alternate embodiment of skid 10 is shown in FIG. 5. Pallet 50 is identical to skid 10 with the exception that a pair of bottom deck boards 60 extend transversely across the opposite ends of the three runners and with the further exception that the bracket securing the deck boards to the runners is provided both with a top wall and a bottom wall which form a pair of slots to receive the top and bottom deck boards and with the further result that recess 37 is therefore not provided in the bracket of FIG. 5. Only a single runner 11 has been shown in FIG. 5, it being understood that the pallet includes two additional runners 12 and 13 as described for the embodiment of FIG. 1. Likewise, only one end of runner 11 has been shown, it being understood that the runner includes an opposite end with a bracket mounted thereto for mounting and securing a second set of top and bottom deck boards.

Bracket 50 includes a pair of side walls 55 and 56 integrally joined and perpendicularly arranged to end wall 51, in turn, integrally joined and perpendicularly arranged to a top wall 52 and bottom wall 54. Walls 52 and 54 are parallel and are spaced apart respectively from the upper and lower edges of side walls 55 and 56 forming a pair of slots in which top deck board 20 and bottom deck board 60 are positioned. The top wall 52 and bottom wall 54 include a plurality of holes 61 through which conventional fastening devices are extended through boards 20 and 60 and into runner 11 fixedly securing the deck boards, runner and bracket together. Likewise, side walls 55 and 56 include a plurality of apertures 61 through which conventional fastening devices are extended securing the side walls to runner 11. Bottom deck boards 60 are parallel to the upper deck boards 20 and are perpendicularly arranged with respect to the runners. End wall 53 extends from top wall 52 downwardly past the slots receiving boards 20 and 60 to bottom wall 54. Thus, brackets 51 are used to form a pallet having top deck boards as well as bottom deck boards fixedly fastened to the opposite ends of the runners.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A storage platform comprising:

a plurality of parallel wooden elongated runners extending in a first direction, each of said runners including a pair of ends with said ends including one end and an opposite end and further with parallel opposite side surfaces extending therebetween and a top surface extending perpendicularly to and between said side surfaces;

a plurality of top wooden elongated deck boards each mounted to and extending perpendicularly across said runners at said ends and resting atop said top surface; and, a plurality of brackets mounted to said runners at said ends with each of said brackets separated apart from the remaining of said brackets and with each bracket mounted to a separate single end of a separate single runner, said brackets each including a pair of vertical side walls positioned adjacent and fixedly attached to said side surfaces and further including an end wall joined to and positioned perpendicularly to and between said side walls with said brackets further including a top wall spaced apart from but attached by said end wall to said vertical side walls forming a top slot into which a deck board extends being fixedly attached thereto, said top wall cantileveredly joined to said end wall and extending therefrom in the same direction as said first direction from said end wall and said one end toward said opposite end with said top wall attached directly to said deck boards directing any lifting force applied to said deck boards through said top wall directly to said end wall and said ends of said runners.

2. The platform of claim 1 wherein:

said runners include two outer runners and a middle runner positioned therebetween and parallel therewith with said brackets located on said ends of said two outer runners and said middle runner, and further comprising:

fastening devices extending through said top wall of said brackets and into both said deck boards and said two outer runners and said middle runner;

a band extendable around said platform to secure cargo located atop said platform.

3. The platform of claim 1 and further comprising:

a plurality of bottom wooden elongated deck boards each mounted to and extending perpendicularly across said runners at said ends and resting therebeneath; and, said brackets further include a bottom wall spaced apart from said vertical side walls forming a bottom slot into which a bottom deck board extends being fixedly attached thereto.

4. The platform of claim 3 wherein:

said top wall and said bottom wall are integrally joined to said end wall and said side walls with said bottom wall parallel to said top wall, said end wall extends from said top wall downwardly past said top slot and said bottom slot to said bottom wall, said bottom wall extends in the same direction as said first direction from said end wall and said one end toward said opposite end.

5. A storage platform comprising:

a plurality of parallel wooden elongated runners extending in a first direction, each of said runners including a pair of ends with said ends including one end and an opposite end and further with parallel opposite side surfaces extending therebetween and a top surface extending perpendicularly to and between said side surfaces;

a plurality of top wooden elongated deck boards each mounted to and extending perpendicularly across said runners at said ends and resting atop said top surface; and, a plurality of bracket means mounted to said runners at said ends with said plurality of bracket means separated apart with each bracket means mounted to a separate single end of a separate single runner, each of said bracket means include an end wall, side walls and a top wall with said top wall cantileveredly joined to said end wall and extending therefrom in the same direction as said first direction from said end wall and said one end toward said opposite end and further with each of said bracket means positioned adjacent and fixedly attached to said side surfaces and said deck boards operable to limit splitting of said runners at said ends as lifting force is applied to said deck boards and then through said top wall and via said end wall to said side surfaces.

6. The platform of claim 5 wherein:

said runners include two outer runners and a middle runner positioned therebetween and parallel therewith with said bracket means located on said ends of said two outer runners and said middle runner, and further comprising:

fastening devices extending through said top wall of said bracket means and into both said deck boards and said two outer runners and said middle runner;

a band extendable around said platform to secure cargo located atop said platform.

7. The platform of claim 5 and further comprising:

a plurality of bottom wooden elongated deck boards each mounted to and extending perpendicularly across said runners at said ends and resting therebeneath; and, said bracket means fixedly attaches said bottom deck boards to said runners.

* * * * *